US005319180A

United States Patent [19]

Locher et al.

[11] Patent Number: 5,319,180

[45] Date of Patent: Jun. 7, 1994

[54] GLOW PLUG WITH CONSTANT-STRUCTURE COBALT-IRON PTC RESISTOR

[75] Inventors: Johannes Locher, Stuttgart; Friedrich Mühleder, Sindelfingen; Bernhard Kaczynski, Waiblingen; Werner Teschner, Filderstadt, all of Fed. Rep. of Germany

[73] Assignee: Robert Bosch GmbH, Stuttgart, Fed. Rep. of Germany

[21] Appl. No.: 862,589

[22] PCT Filed: Mar. 1, 1991

[86] PCT No.: PCT/DE91/00181

§ 371 Date: Jun. 26, 1992

§ 102(e) Date: Jun. 26, 1992

[87] PCT Pub. No.: WO91/15717

PCT Pub. Date: Oct. 17, 1991

[30] Foreign Application Priority Data

Mar. 31, 1990 [DE] Fed. Rep. of Germany ..... 4010479

[51] Int. Cl.[5] ..... F23Q 7/00; H05B 3/00; F02P 19/02

[52] U.S. Cl. ..... 219/270

[58] Field of Search ..... 219/260–270, 219/544, 553; 123/145 R, 145 A; 361/264–266

[56] References Cited

U.S. PATENT DOCUMENTS

| | | | |
|---|---|---|---|
| 4,144,380 | 3/1979 | Beltran | 428/679 |
| 4,423,309 | 12/1983 | Murphy et al. | 219/270 |
| 4,477,717 | 10/1984 | Walton | 219/270 X |
| 4,556,781 | 12/1985 | Bauer | 219/270 |
| 5,093,555 | 3/1992 | Dupuis et al. | 219/270 |

FOREIGN PATENT DOCUMENTS 3825012 1/1990 Fed. Rep. of Germany .

2216952 10/1989 United Kingdom .

OTHER PUBLICATIONS

Patent Abstracts of Japan, vol. 6, No. 210 (M-166), Oct. 1982, summarizing Koyama/Hitachi JP-A-57-115622 publ. 19 Jul. 1982, "Heat Resistant Member In Preheating Plug For Diesel Engine."

*Primary Examiner*—Anthony Bartis

*Attorney, Agent, or Firm*—Frishauf, Holtz, Goodman & Woodward

[57] ABSTRACT

A sheathed-element glow plug for disposition in the combustion chamber of air-compressing internal combustion engines is proposed which in a known manner contains a resistor element (17) in its sheathed-element (13), where this resistor element (17) is composed of two serially connected resistor spirals (20, 21). While the resistor spiral (20) on the combustion chamber side is a heater spiral with a resistance behavior which is essentially the same at all operating temperatures, the wirespiral shaped resistance spiral (21) on the side remote from the combustion chamber which acts as a regulating element, has a high temperature resistance coefficient. This resistance spiral (21) consists of a cobalt-iron alloy, which is not subject to material breakdown under the temperature stresses occurring in an internal combustion engine; the cobalt-iron alloy has been selected in such a way that it maintains a cubic face-centered material structure during all operational stages of the sheathed-element glow plug (10) from 0°–1200° C.; the iron content of this cobalt-iron alloy lies between 6 and 18 weight percent, preferably at 2 to 14 weight percent. The resistor element (17) formed as a wire spiral is embedded in a known manner in an insulating material (18), which is electrically insulating and conducts heat well.

4 Claims, 1 Drawing Sheet

GLOW PLUG WITH CONSTANT-STRUCTURE COBALT-IRON PTC RESISTOR

FIELD OF THE INVENTION

The invention relates to a sheathed-element glow plug for disposition in the combustion chamber of air-compressing internal combustion engines.

BACKGROUND

The basic structure and the function of such a sheathed-element glow plug is recited in DE-PS 28 02 625 and U.S. Pat. No. 4,556,781. The sheathed-element of this sheathed-element glow plug contains a resistor element embedded in an insulating material, which is composed of two series-connected resistor spirals. The resistor spiral on the combustion chamber side of this resistor element is used as a heating element and has a resistance which essentially is independent of temperature, while the resistor spiral on the side removed from the combustion chamber has a high positive temperature resistance coefficient and acts as a regulating element; in this case the latter is made of nickel.

A glow plug is known from DE-PS 38 25 012 and U.S. Pat. No. 5,093,555 HAUSCH and Schieck assigned BERU RUPRECHT et al., which in principle has the same structure and the same function as the sheathed-element glow plug of the above mentioned DE-PS 28 02 625, but uses a cobalt-iron alloy or a nickel-iron alloy for the regulating element, where the content of iron is 20 to 25 weight percent. These two above mentioned alloys have a cubic body centered structure at room temperature, while they change into a cubic face centered structure when heated to a range between room temperature and 1000° C. It has been shown that these last mentioned sheathed-element glow plugs only have a relatively short service life because of the breakdown of the material of the regulating element, lead to unwanted interruptions in operation and additionally entail expenses for correcting the trouble. The invention In contrast thereto, the sheathed-element glow of the invention with the a cobalt-iron alloy resistor coil, whose iron content falls in a range between 6 and 18 weight-percent, present invention has the advantage that there is no breakdown of the regulating element of the resistor element after a relatively short length of operation and that service interruptions and expenses as a result thereof are avoided. This alloy maintains a cubic face-centered structure throughout a temperature range from not more than 0° C. to at least 1000° C.

Advantageous further developments of the sheathed-element glow plug are described below; it is particularly advantageous if the regulating element of the resistor element consists of a cobalt-iron alloy, the iron content of which is 12 to 14 weight percent.

Preferably, the regulating element is located in a section of the sheathed-element not radially surrounded by the metal housing.

BRIEF DESCRIPTION OF THE DRAWINGS

An exemplary embodiment of the invention is illustrated in the drawings and explained in detail in the following description.

DETAILED DESCRIPTION OF A PREFERRED EMBODIMENT

Figure 1:
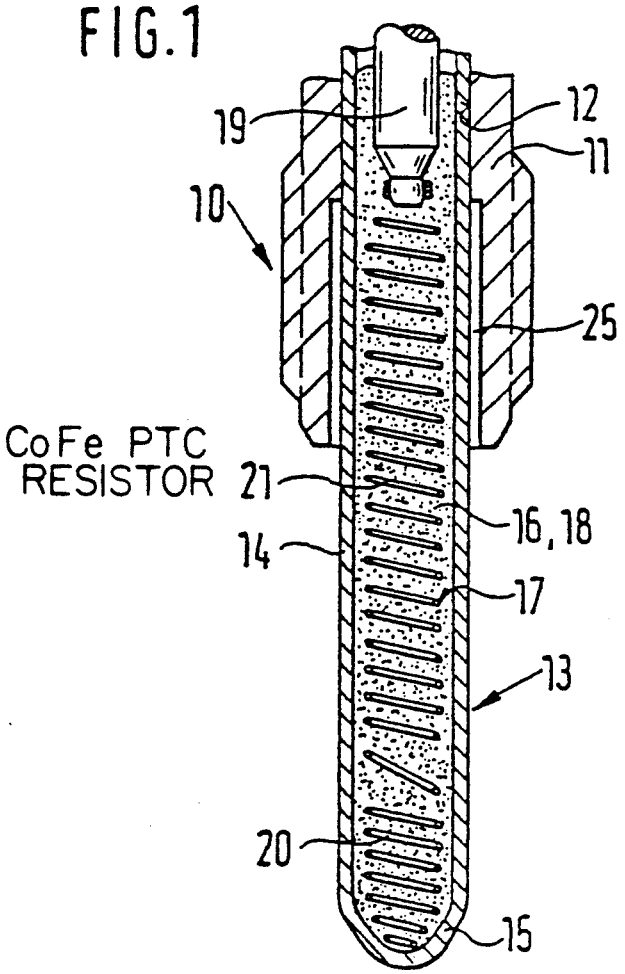
FIG. 1 shows a longitudinal section through the area on the combustion chamber side of the sheathed-element glow plug of the invention in an enlarged view.
Figure 2:
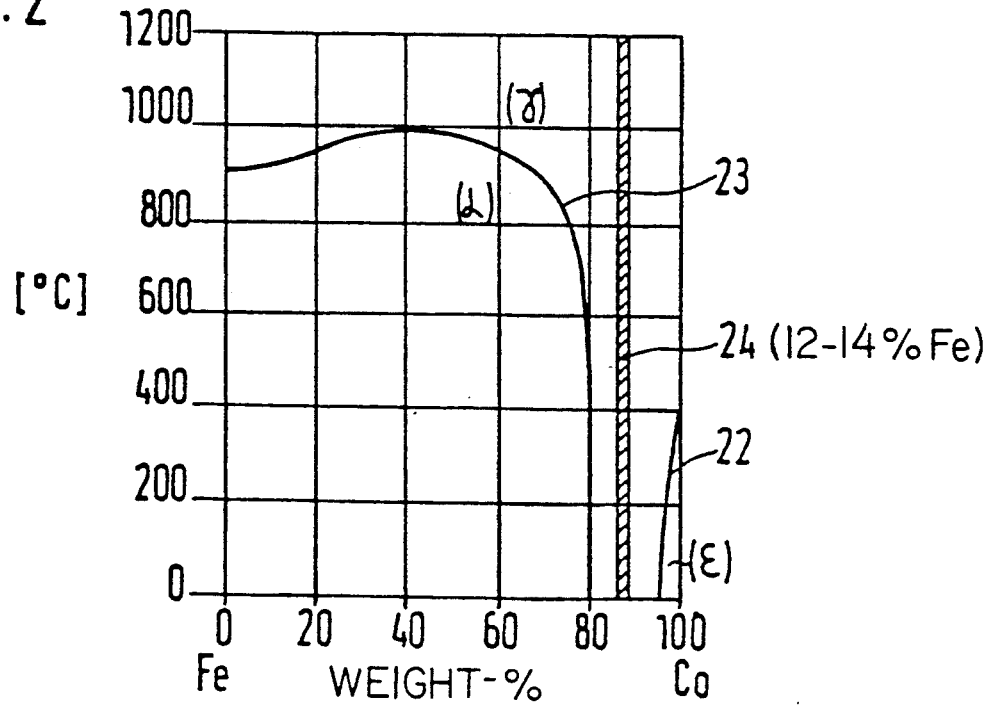
FIG. 2 shows a cobalt-iron diagram showing the material structures as a function of temperature and alloy ratio.

The sheathed-element glow plug 10 shown in FIG. 1 is provided for use in a combustion chamber, not shown, of air-compressing internal combustion engines. This sheathed-element glow plug 10 has a pipe-shaped metal housing 11, in the longitudinal bore 12 of which a sheathed-element 13 is sealingly fixed with a portion of its length. This sheathed-element 13 has a corrosion-resistant thin-walled glow pipe 14, which is closed off on its combustion chamber side with a bottom 15. An electrical resistor element 17, which extends in the axial direction, extends through the interior of the glow pipe 14, is embedded in an insulating material 18 (for example magnesium oxide powder), is provided on the side remote from the combustion chamber with a connector part 19 for electric current, is electrically conducting on the combustion chamber side and fixedly connected with the bottom 15 of the glow pipe 14 and is composed of two serially connected resistor spirals 20, 21. In this case, the resistor spiral 20 on the combustion chamber side is used as heating element and the resistor spiral 21 on the side remote from the combustion chamber acts in a known fashion as regulating element because of its high positive temperature resistance coefficient; while the resistor spiral 20 used as heating element consists in a known manner of a wire material with an essentially temperature-independent resistance behavior (for example a chromium-aluminum-iron alloy), the resistor spiral 21 used as regulating element is selected to consist of a cobalt-iron alloy. In accordance with the invention, the resistor spiral 21 used as regulating element is composed of such an alloy of cobalt and iron, so that, during all operational states of the sheathed-element glow plug 10, it maintains a cubic face centered structure ($\gamma$). This cubic face centered structure ($\gamma$) of the cobalt-iron alloy of such a resistor element 21 used as regulating element results if the alloy has approximately between 6 and 18 weight percent of iron. When used as resistor spirals 21 in sheathed-element glow plugs 10, cobalt-iron alloys containing less than 6 or more than 18 weight percent of iron pass through other material structures (see FIG. 2) in addition to the cubic face centered structure ($\gamma$). With fewer than 6 weight percent of iron in the cobalt-iron alloy, at room temperature this resistor spiral 21 would first have a hexagonal material structure ($\epsilon$) which would—depending on the iron content—only take on a cubic face centered structure ($\gamma$) with rising temperatures. With more than 18 weight percent of iron in a cobalt-iron alloy, this material would have a cubic body centered structure ($\alpha$), and this at least up to 400° C., but mostly as far as the range between 800° C. and 900° C., before changing into a cubic face centered structure ($\gamma$). The preferred range for a cobalt-iron alloy suitable for a resistor spiral 21 used as regulating element contains 12 to 14 weight percent of iron. In the diagram of cobalt-iron alloys shown in FIG. 2, the temperatures from 0° to 1200° C. are entered on the perpendicular, and on the horizontal are possible contents of iron or cobalt for a cobalt-iron alloy; the contents are expressed in weight percent. Impurities or processing additives, which as a rule hardly exceed one weight percent of the alloy, have been omitted in the above information. The function lines 22 and 23 drawn into this diagram separate the regions of different material structures from each other. Function line 22 separates the region of hexagonal material structure ($\epsilon$) from the region of cubic face centered material structure ($\gamma$), while function line 23 separates the region of cubic body centered material structure ($\alpha$) from the region of cubic face centered material structure ($\gamma$). The cobalt-iron alloy preferred for this purpose, which contains 12 to 14 weight percent of iron, has been indicated in the diagram of FIG. 2 as a hatched region 24. A resistor spiral 21 used a regulating element made of an alloy, which at all operational temperatures remains in the alloy range having a $\gamma$-material structure, in particular falls within the region 24, does not undergo material breakup and thus does not cause any operational disruptions and the expenses as a result thereof.

The desired behavior in respect to temperature and time of the resistor element 17 can be more closely adapted to the desired course by means of other known steps. Among these steps is, for example, the disposition of an annular gap 25 between the metal housing 11 and a portion of the length of the sheathed-element 13 (see FIG. 1); such an annular gap 25 is mostly used when it is intended that the free end of the sheathed-element 13 extending from the metal housing 11 on the combustion chamber, side be as short as possible and for this reason a portion of the resistor spiral 21 used as regulating element extends in the area of the sheathed-element 13 which is enclosed by the metal housing 11. As a result of the particularly high temperature resistance coefficient of the cobalt-iron alloy of the invention the axial length of the resistor spiral 21 can in most cases be chosen to be relatively short, so that the regulating spiral (and of course the heater spiral on the combustion chamber side, too) can be completely housed outside of the area of the sheathed-element 13 which is enclosed by the metal housing 11; this latter embodiment of a sheathed-element glow plug should be considered to be a preferred embodiment.

As further steps for adapting the temperature/time course of the sheathed-element glow plug 10, the following can also be employed: adaptation of the wire diameters of the resistor spirals 20 and 21, changes in the gradients of the resistor spirals 20 and 21, variation in the distance between the resistor spiral 20 and the resistor spiral 21, use of insulating materials 18 with various heat conducting abilities (particularly in the area between the two resistor spirals 20 and 21), disposition of intermediate pieces (not shown), which are electrically conducting but do not conduct heat well, between the resistor spiral 20 and the resistor spiral 21.

We claim:

1. A sheathed-element glow plug (10) for disposition in a combustion chamber of an air-compressing internal combustion engine having a pipe-shaped metal housing (11) in a longitudinal bore (12) of which a sheathed-element (13) is sealingly fixed with a portion of its length, said sheathed-element (13) having a thin-walled glow pipe (14), which is closed off, on an end thereof adjacent the combustion chamber, by a bottom (15), in an interior portion (16) of which an electrical resistor element (17) is disposed, which extends axially and is embedded in an insulating material (18), said glow plug being provided on a side remote from the combustion chamber with a connector part (19) for electric current, said resistor element (17) is electrically conducting on the combustion-chamber side and fixedly connected with the bottom (15) of the glow pipe (14) and is composed of two serially connected resistor spirals (20, 21), wherein the resistor spiral (20) on a combustion-chamber side of said glow plug serves as a heating element and the resistor spiral (21), on a side remote from the combustion chamber, is an alloy, with a positive temperature coefficient of resistance, containing 6–18 weight-percent iron, 81–94 weight-percent cobalt, any remainder not exceeding one weight-percent, and serves as a regulating element;

the resistor spiral (21) used as said regulating element maintains a cubic face-centered structure throughout an operating temperature range, of the sheathed-element glow plug, extending from at least 0° to at least 1200° C.

2. A sheathed-element glow plug in accordance with claim 1, characterized in that the cobalt-iron alloy of the resistor spiral (21) used as regulating element has between 12 and 14 weight-percent of iron.

3. A sheathed-element glow plug in accordance with claim 2, characterized in that the resistor spiral (20) used as heater element, as well as the resistor spiral (21) used a regulating element of the resistor element (17), are essentially disposed within a section of length of the sheathed-element (13) which is not radially directly in contact with the metal housing (11).

4. A sheathed-element glow plug in accordance with claim 1, characterized in that the resistor spiral (20) used as heater element, as well as the resistor spiral (21) used a regulating element of the resistor element (17), are essentially disposed within a section of length of the sheathed-element (13) which is not radially directly in contact with the metal housing (11).

* * * * *